US005594488A

United States Patent [19]

Tsushima et al.

[11] Patent Number: 5,594,488

[45] Date of Patent: Jan. 14, 1997

[54] THERMAL HEAD

[75] Inventors: Noboru Tsushima; Toshiya Endoh, both of Takizawa-mura; Satoru Sasaki; Ken Yamamura, both of Morioka; Takashi Shirakawa, Takizawa-mura; Toshifumi Nakatani, Morioka; Akinori Takahashi, Tamayama-mura, all of Japan

[73] Assignee: Alps Electric Co., Ltd., Tokyo, Japan

[21] Appl. No.: 438,573

[22] Filed: May 10, 1995

[30] Foreign Application Priority Data

| | | | |
|---|---|---|---|
| May 12, 1994 | [JP] | Japan | 6-098889 |
| Jul. 28, 1994 | [JP] | Japan | 6-177099 |
| Jul. 29, 1994 | [JP] | Japan | 6-178952 |

[51] Int. Cl.[6] ..... B41J 2/32; B41J 2/335

[52] U.S. Cl. ..... 347/208

[58] Field of Search ..... 347/200, 201, 347/202, 203, 204, 205, 206, 208

[56] References Cited

U.S. PATENT DOCUMENTS

| | | | |
|---|---|---|---|
| 4,768,038 | 8/1988 | Shibata | 347/208 |
| 5,091,736 | 2/1992 | Narita | 347/208 |
| 5,148,188 | 9/1992 | Ota et al. | 347/208 |

FOREIGN PATENT DOCUMENTS

| | | | |
|---|---|---|---|
| 5305719 | 11/1993 | Japan | 347/208 |
| 6115130 | 4/1994 | Japan | 347/208 |

*Primary Examiner*—Benjamin R. Fuller
*Assistant Examiner*—L. Anderson
*Attorney, Agent, or Firm*—Guy W. Shoup; Patrick T. Bever

[57] ABSTRACT

A thermal head including a temperature keeping layer disposed on a substrate, a plurality of heat generating elements formed on the temperature keeping layer, a plurality of individual electrodes connected to the corresponding heat generating elements, a common electrode connected to the heat generating elements, respectively. Each heat generating element includes a heat generating portion formed between one of the individual electrodes and the common electrode. Each of the individual electrodes and the common electrode have a dual layered structure including a lower electrode and an upper electrode, the lower electrode being formed between the temperature keeping layer and one of the heat generating elements, and the upper electrode being formed above the heat generating element.

17 Claims, 11 Drawing Sheets

THERMAL HEAD

BACKGROUND OF THE INVENTION

1. Field of the Invention

The present invention concerns a thermal head mounted on a thermal printer for conducting intended printing by heating under the supply of electric current in accordance with printing information.

2. Description of the Prior Art

A thermal head mounted on a thermal printer such as a heat sensitive printer or heat transfer printer has generally been adapted, for example, to arrange a plurality of heat generating elements linearly on an insulative substrate and heat each of the heating elements selectively under current supply in accordance with electric printing information, thereby conducting color developing recording on heat sensitive recording paper referred to as thermal paper in a heat sensitive printer, or melting an ink of an ink ribbon and transferring and recording the same on common paper in a heat transfer printer.

FIG. 16 shows an example of a thermal head of this type in the prior art. A glaze layer 2 made of heat resistant glass which is less heat conductive and functions as a temperature keeping layer is laminated such that the upper surface is flat on the upper surface of an insulative substrate 1 made of alumina or the like, substantially over the entire surface of the insulative substrate 1. A plurality of heat generating elements 3 made of a heat generating resistor material such as $Ta_2N$ or Ta—$SiO_2$ are formed linearly on the upper surface of the glaze layer 2 by laminating entirely by means of vapor deposition or sputtering and then etching by photolithography. A common electrode 4*a* and individual electrodes 4*b* are formed respectively at the upper surface on both sides of each of the heat generating elements 3 for supplying electric current to each of the heat generating elements 3. Each of the electrodes 4*a* and 4*b* is made, for example, of a soft metal such as Al, Cu and Au, laminated entirely to a thickness of about 2 um, for example, by vapor deposition or sputtering and then photolithographically etched and formed into a pattern of a desired shape.

Then, each of the heat generating elements 3 is formed independently and individually such that a heat generating portion 3A corresponding to 1 dot as the minimum printing unit is exposed between the common electrode 4*a* and individual electrodes 4*b*. The heat generating portion 3A of each heat generating element 3 is caused to generate heat by applying a voltage between each of the electrodes 4*a* and 4*b*.

A protection layer 7 of about 7 to 10 um thickness is laminated on the upper surface of the insulative substrate 1, the glaze layer 2, each of the heat generating elements 3 and each of the electrodes 4*a* and 4*b* for protecting each of the heat generating elements 3 and each of the electrodes 4*a* and 4*b*. The protection layer 7 comprises an oxidation resistant layer 8 of about 2 um thickness made, for example, of $SiO_2$ for protecting each heat generating element 3 against oxidative degradation and a wear resistant layer 9 of about 5 to 8 um thickness, for example, made of $Ta_2O_5$ laminated on the oxidation resistant layer 8 for protecting each of the heat generating elements 3 and each of the electrodes 4*a* and 4*b* against wearing caused by contact with a heat sensitive recording material such as heat sensitive recording paper and an ink ribbon. The protection layer 7 covers all the surface except for terminal portions of each of the electrodes 4*a* and 4*b*. The oxidation resistant layer 8 and the wear resistant layer 9 of the protection layer 7 are formed successively, for example, by sputtering or like other means.

However, in the thermal head of the prior art described above, since the thickness for each of the electrodes 4*a* and 4*b* are about 2 um, a step is formed between the heat generating portion 3A of each heat generating element 3 and the corresponding top end of the electrodes 4*a* and 4*b*. Accordingly, a concave portion formed above the heat generating portion 3A situating between the common electrode 4*a* and individual electrode 4*b* can not be eliminated even if the portion thereabove is covered with the protection layer 7. As a result, upon conducting printing by a heat sensitive recording member such as an ink ribbon, there is a problem that heat conduction with respect to the heat sensitive member is poor in the concave portion since it causes a space in which the heat conductivity from the thermal head to the heat sensitive recording member is most reduced and no intact printing can be attained, particularly, to so-called rough paper with roughened surface. Further, since the electrodes 4*a* and 4*b* are generally made of a soft material such as Al, the pressing force exerted from a platen as a back-up for the heat sensitive recording member causes deformation, depletion or peeling of the protection layer 7 above the top end of Al or the like constituting the electrodes 4*a* and 4*b*, which cause changes in the resistance value of each heat generating element 3 to deteriorate printing or the reduce the reliability and the working life of the thermal head.

In a countermeasure for the problem, as shown in FIG. 17, a protrusion 2A having an arcuate vertical cross section and extending linearly is formed on a substrate 1, a small protrusion 2B of a generally trapezoidal vertical cross section is formed to a thickness of several um at a top portion of the protrusion 2A, and the top ends of the common electrode a and the individual electrode 4*b* are disposed below the small protrusion 2B for preventing formation of the concave portion in the heat generating portion 3A.

With such a constitution, satisfactory printing quality can be ensured without increasing the application voltage by so much. However, when the small protrusion 2B of the trapezoidal cross section is disposed and the top end for each of the electrodes is disposed at a position lower than the top face of the small protrusion 2B, since steps are present on both sides of the small protrusion 2B, the thickness of the photoresist varies greatly upon forming the heat generating elements 3 by photolithographic etching, and since the accuracy for exposure is lowered along with the occurrence of the gap with respect to the mask, a pattern can not be formed at a high accuracy on the small protrusion 2B to bring about a problem of causing short etching or over etching thereby often varies the resistance value.

In view of the above, for overcoming the foregoing problems in the prior art it has been proposed, as shown in FIG. 18, to form the electrodes 4*a* and 4*b* with dual layers in which thin lower individual electrode 5*b* and a lower common electrode 5*a* of the lower layer are formed near the top of the glaze layer 2, while main upper individual electrode 6*b* and upper common electrode 6*a* of the upper electrode are formed at positions retracting from the top portion thereby reducing the step between the heat generating portion 3A and the electrodes on both sides.

However, in this structure, upon forming the pattern of the lower electrodes 5*a* and 5*b*, it is necessary for such etching as not damaging the heat generating element 3 formed therebelow, to bring about a problem that a range for selecting the heat sensitive device material and the electrode material is narrowed. Particularly, if the pattern is intended to be formed by effective dry etching for improving the pattern accuracy, since the Ta—Si—O or Nb—Si—O system as the high specific resistivity material and a low resistance high melting metal such as Mo and W as an effective material for the lower electrode are etched in common by a fluorine series etching gas, it is possible for dry etching by using $CF_4$ series gas which is simple in view of the process and has been used with much satisfactory result. Further, if the etching for the pattern of the heat generating elements 3 and the etching for the electrode are conducted separately by the prior art method, patterns tend to be deviated in the direction of arranging the heat generating portions 3A between the lower electrode for supplying electric power and the pattern of the heat generating elements 3. Deviation of the pattern, if any, causes short circuit between adjacent heat generation portions 3A or varies the resistance value to lower the yield.

Further, for printing on rough paper at a high speed, it is necessary for so-called hot peeling of peeling and transferring an ink layer of an ink ribbon while the heated ink layer is not yet cooled substantially. Accordingly, it is demanded to shorten the distance from the heat generation portion 3A to the edge of the head on the side of the common electrode as much as possible, but it has been impossible in the prior structure to form the common electrode on the edge at a good accuracy.

Further, in a thermal head of the prior art as shown in FIG. 19, a glaze layer 52 made of a material of low heat conductivity such as heat resistant glass and functioning as a temperature keeping layer is laminated to the upper surface of a substrate 51 made of an insulating material such as alumina, substantially over the entire surface of the substrate 1 such that a portion protrudes upwardly. A plurality of heat generating resistor bodies 53 made of a material, for example, $Ta_2N$ or Ta—$SiO_2$ are formed linearly on the upper surface of the protruding portion of the glaze layer 52 by means of vapor deposition, sputtering or the like and then etched into a predetermined pattern by photolithography. Further, individual electrodes **54*a* connected individually to the heat generating resistors 53, respectively, and a common electrode 54*b* connected to all of the heat generating resistors 53 are formed respectively to the upper surface on both sides of each of the heat generating resistor bodies 53. Each of the electrodes 54*a* and 54*b* is made, for example, of a soft metal such as Al, Cu and Au, laminated by vapor deposition, sputtering or the like and then formed into a desired pattern by photolithographic etching. Then, each of the heat generating resistor bodies 53 is formed independently and individually so as to expose a heat generating portion 53*a* corresponding to one dot as the minimum printing unit between the common electrode 54 and the individual electrode 54*a***.

Further, a protection layer 55 is laminated to the upper surface of the substrate 51, the glaze layer 52, each of the heat generating resistor bodies 53 and the each of the electrodes **54*a* and 54*b* for protecting each of the heat generating resistors 53 and each of the electrodes 54*a* and 54*b*. The protection layer 55 comprises an oxidation resistant layer 56 made, for example, of $SiO_2$ for protecting the heat generating resistor body 53 from oxidative degradation and a wear resistant layer 57 made, for example, of $Ta_2O_5$ laminated on the oxidation resistant layer 56 for protecting each of the heat generating resistors 53 and each of the electrodes 54*a* and 54*b* from wearing caused by contact with heat sensitive recording material such as a heat sensitive recording sheet and an ink ribbon. The protection layer 55 covers all the surface other than the terminal portion of each of the electrodes 54*a*, 54*b*, and the oxidation resistant layer 56 and the wear resistant layer 57 of the protection film 55** are successively formed by means of sputtering or the like.

In the existent thermal head of this type, electric current is supplied selectively to the individual electrodes **54*a* based on a predetermined printing information thereby causing the heat generating portion of the corresponding heat generating resistor body 53** to generate heat and conducting color developing recording on a heat sensitive recording sheet or melting the ink of the ink ribbon thereby conducting transfer recording to perform desired printing.

However, in the existent thermal head, since the top ends for the electrodes **54*a* and 53*b* are formed on both sides of the protruding portion of the glaze layer 52, steps are formed at the top ends of the electrodes 54*a* and 54*b*, and the steps remarkably increase the variation in the thickness of the photoresist upon etching each of the electrodes 54*a* and 54*b*** by photolithographic etching, and the steps cause a gap relative to the mask to reduce the exposure accuracy, so that the pattern can not be formed at a high accuracy, short etching or over etching is caused to often vary the resistance value.

For dissolving the foregoing problems in the prior art, the present applicant, et al have developed a thermal head having each of the electrodes being formed as dual layers, in which lower individual electrodes and a lower common electrode of the lower layer made of a material, for example, Mo are formed on the lower surface of the heat generating resistor body, and upper individual electrodes and an upper common electrode of the upper layer made of a material, for example, Al are formed on the upper surface of the heat generating resistor body at positions retracting from the top of the protruding portion of the glaze layer, thereby reducing the step between the heat generating portion and the electrodes on both sides.

In such a thermal head, since the step between the heat generating portion of the heat generating resistor body and the electrodes on both sides can be reduced, variation in the thickness of the photoresist can be reduced remarkably and, in addition, the pattern can be formed at a high accuracy, thereby enabling to prevent the occurrence of short etching or over etching to prevent variation of the resistance value.

However, in the thermal head described above, since the heat generating portion of the heat generating resistor body made of a material, for example, Ta—$SiO_2$ is formed to the upper surface of the glaze layer, and lower electrodes made of a material such as Mo are disposed on both sides of the heat generating portion. Then, since the stresses in the films of the materials for forming the heat generating resistor and the lower electrode are different, there is a problem that adhesion between the lower electrode and the glaze layer is remarkably deteriorated to result in the peeling of the lower electrode and the reduce the head quality.

OBJECT AND SUMMARY OF THE INVENTION

The present invention has been achieved for overcoming the foregoing problems and it is an object of the present invention to provide a thermal head capable of easily forming a heat generating portion of a highly accurate heat generating element, and capable of improving the printability to rough paper and stabilizing the yield.

Another object of the present invention is to provide a thermal head capable of improving adhesion between the lower electrode and the glaze layer and capable of remarkably improving the quality of the head.

DESCRIPTION OF THE PREFERRED EMBODIMENTS

Figure 1:
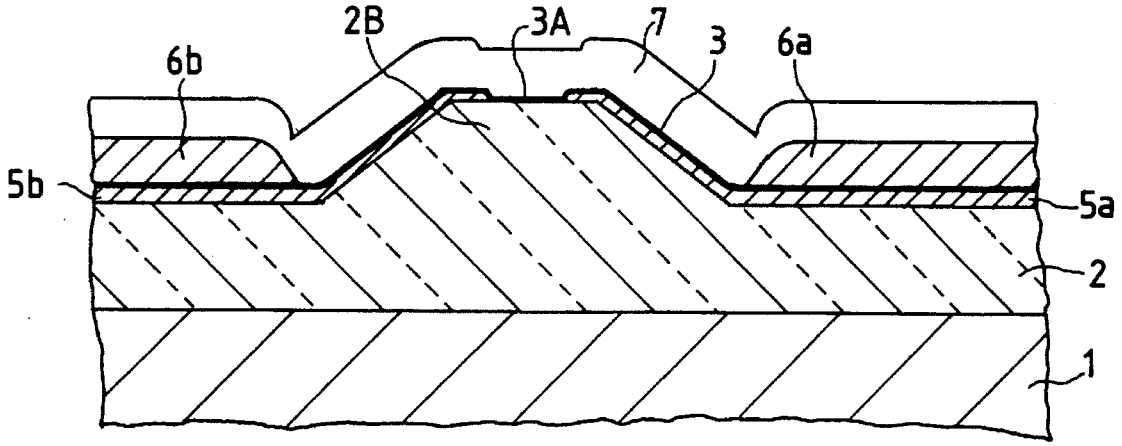
FIG. 1 is a vertical cross sectional view illustrating a first embodiment of a thermal head according to the present invention.

The present invention will now be explained with reference to preferred embodiments shown in the drawings. Identical components and portions with those in the prior art described previously carry the same reference numerals for which duplicate explanations will be omitted.

FIG. 1 shows a preferred embodiment of a thermal head according to the present invention. In FIG. 1, a thermal head of this embodiment comprises an electrically insulating substrate 1 such as made of alumina ceramic, a glaze layer 2 as a less heat conductive temperature keeping layer formed protrudingly so as to have a small protrusion 2B, a lower electrode comprising lower individual electrodes **5*b* and a lower common electrode 5*a* made of a metal material such as Mo, Ti, W, Nb, Ta or Zr, or an alloy comprising the same as the main ingredient and extended as far as the top of the small protrusion 2B, heat generating elements 3 each made of a mixture such as Ta—$SiO_2$ or Nb—$SiO_2$ and having a heat generating portion 3A as a heat generating region, upper electrodes each made of a material such as Al and comprising upper individual electrodes 6*b* and an upper common electrode 6*a* spaced apart from a boundary between the lower electrodes 5*a* and 5*b* and each heat generating element 3 and formed on the heat generating element 3 at a position lower than the top of the small protrusion 2B, and a protection layer 7 formed so as to cover the upper electrodes each comprising the individual electrode 6*b* and the upper common electrode 6*a*, the heat generating element 3 and the upper electrodes 6*a* and 6*b* for protecting them. The height up to the top of the small protrusion 2B is about 10 to 30 um, the thickness of the lower electrodes 5*a* and 5*b* is about 20 to 300 nm, preferably, about 50 to 200 nm, more preferably, about 100 nm and, further, the thickness of the heat generating elements 3 is greater than the thickness of the lower electrodes 5*a* and 5*b*. Considering the reliability for contact at the boundary between the lower electrodes and the heat generating elements 3, the thickness of the heat generating elements 3 is desirably not less than 1.5 times of the lower electrodes 5*a* and 5*b***.

With such a constitution, since the thermal head in this embodiment has a structure in which the heat generating elements 3 is formed above the lower electrodes **5*a* and 5*b*, the upper individual electrode 6*b*** is sufficiently separated and a heat generating element having a real edge and at a high accuracy can be formed. Accordingly, printing of letters and pictures at higher quality can be ensured.

Explanation will be made to a method of manufacturing the embodiment described above.

Figure 2A:
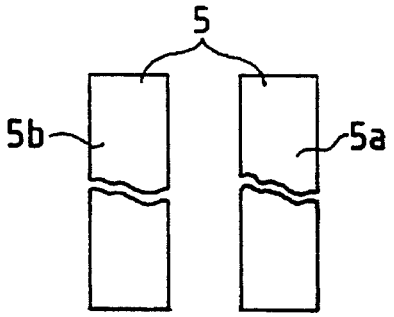
FIG. 2(*a*) is a plan view and FIG. 2(*b*) is a vertical cross sectional view illustrating a state of forming lower electrodes in the manufacturing process shown in FIG. 1.
Figure 2B:
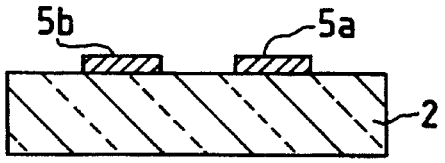
Figure 3A:
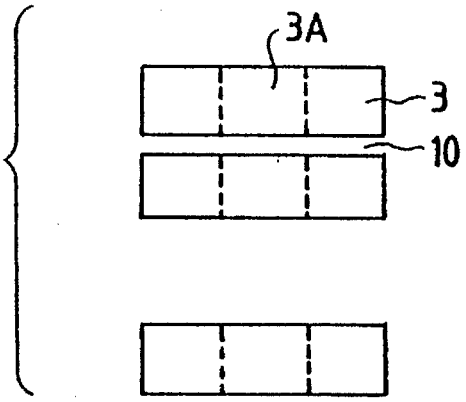
FIG. 3(*a*) is a plan view and FIG. 3(*b*) is a vertical cross sectional view illustrating a state of forming heat generating elements in the manufacturing process shown in FIG. 1.
Figure 3B:
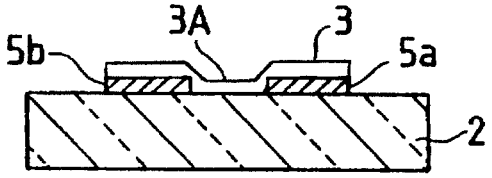
Figure 4A:
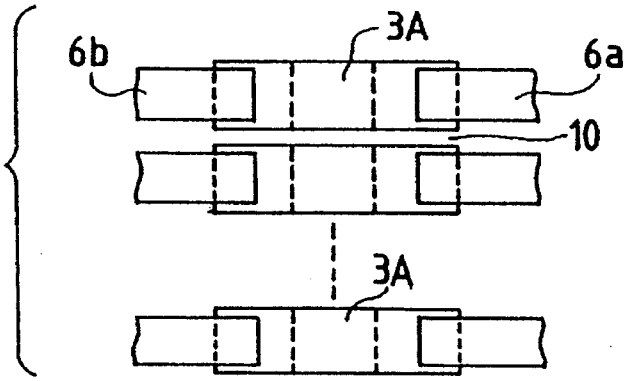
FIG. 4(*a*) is a plan view and FIG. 4(*b*) is a vertical cross sectional view illustrating a state of forming upper electrodes in the manufacturing process shown in FIG. 1.
Figure 4B:
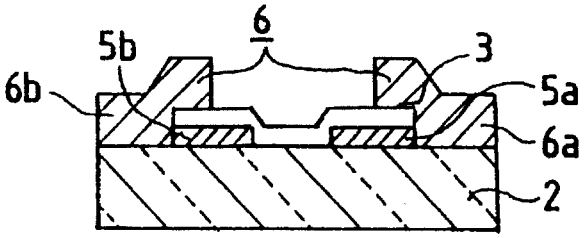

FIG. 2 through FIG. 4 show schematic views for the manufacturing method. For the sake of explanation, it is assumed here that the glaze layer 2 has not a convex shape forming the small protrusion 2B but a planer shape. Further, in each of the drawings, (a) is a plan view and (b) is a vertical cross sectional view. At first in FIGS. 2(*a*) and 2(*b*), Mo or the like as the lower electrode 5 is formed as a film on the glaze layer 2 by means of vapor deposition, sputtering or the like and then a pattern is formed by photolithography for defining an inter-electrode distance for a heat generating region of the heat generating elements 3, namely, a dot size of the heat generating portion 3A. In this case, dry etching using $CF_4$ type gas is adopted for etching to eliminate the region as the heat generating portion 3A at a good accuracy.

Then in FIGS. 3(*a*) and 3(*b*), the heat generating elements 3 such as made of Ta—$SiO_2$ is formed as a film so as to cover the lower electrodes **5*a* and 5*b* by means of vapor deposition, sputtering or the like. Then, comb-like slits 10 are formed by photolithography for defining the size of the heat generating portions 3A in the direction of arrangement. Since both of Mo, Ti, W, Nb, Ta, Zr or the like as the material for the lower electrodes 5a and 5b and Ta—$SiO_2$, Nb—$SiO_2$, or the like as the material for the heat generating element 3 can be dry etched by the $CF_4$ series gas, a continuous dry etching can be applied by using an identical resist pattern. Accordingly, there is no pattern displacement between the heat generating elements 3 and the lower electrodes for supplying electric current thereto, in the direction of arranging the heat generating portions 3A, and slits 10** can be formed at high accuracy.

Then as shown in FIGS. 4(*a*) and 4(*b*), after forming the upper electrode 6 made of Al or the like on the heat generating elements 3 by means of vapor deposition, sputtering or the like, a pattern is formed at a position spaced apart outwardly from the boundary between the lower electrodes 5a and 5b and the heat generating elements 3 by photolithography for supplying electric current to the individual heat generating portions 3A respectively. In this case, since the boundary between the upper electrode and each heat generating element 3 is separated from the heat generating portion 3A, if the pattern is formed with a slight displacement, no undesired effects are given on heat generation or the like.

As described above, in this embodiment, since the film of the lower electrodes 5a and 5b is formed before the heat generating elements 3 and then dry etched, there is no worry of injuring the heat generating elements 3. In addition, when the film of the heat generating elements 3 is formed and slits 10 for defining the size of in the direction of arranging the heat generating portion 3A are formed, since the lower electrodes 5a and 5b and the heat generating elements 3 can be etched continuously with the identical gas, reduction of the production portion can be expected and the heat generating portion 3A with less variation of the resistance value can be formed at a high accuracy.

Further, since the electrode near the heat generating portion 3A is made of a thin and highly heat resistant hard metal, a thermal head of high durability can be obtained.

Accordingly, printing of letters and pictures at high quality can be conducted by the thermal head in this embodiment.

Then, a second embodiment of the thermal head according to the present invention is shown in FIG. 5 to FIG. 8.

Figure 5:
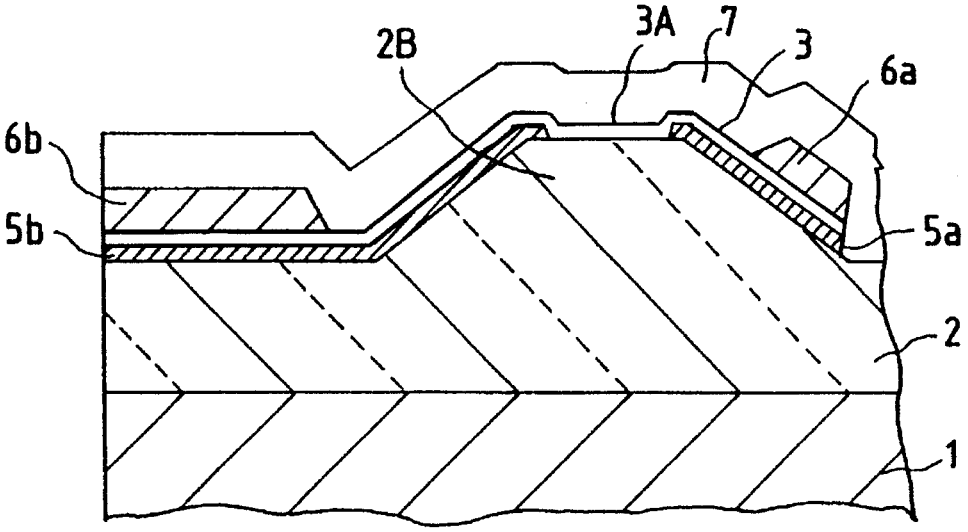
FIG. 5 is a vertical cross sectional view illustrating a second embodiment of a thermal head according to the present invention.

In FIG. 5, the thermal head of the embodiment comprises an electrically insulating substrate 1, a glaze layer 2 having a small protrusion 2B, a lower common electrode 5a and lower individual electrodes 5b formed so as to extend as far as the top of the small protrusion 2B, a heat generating element 3 having a heat generating portion 3A, upper individual electrodes 6b each spaced apart from the top of the small protrusion 2B and formed at a position lower than the top of the small protrusion 2B, an upper common electrode 6a formed above the heat generating element 3 and extended as far as a position at the midway of the slope of the small protrusion 2B and a protection layer 7 formed so as to cover the heat generating element 3 and the upper electrodes 6a and 6b.

Figure 6A:
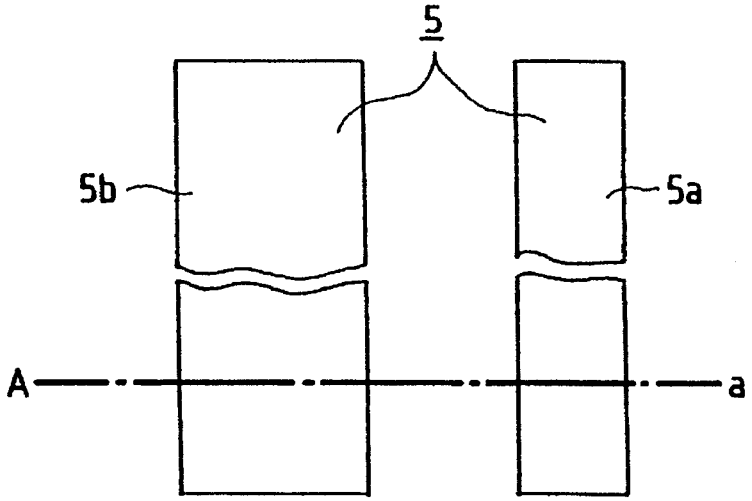
FIG. 6(*a*) is a plan view and FIG. 6(*b*) is a vertical cross sectional view illustrating a state of forming lower electrodes in the manufacturing process shown in FIG. 5.
Figure 6B:
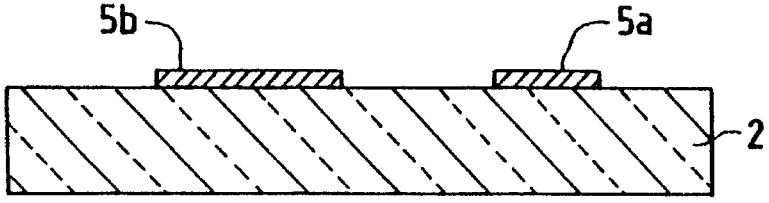
Figure 7A:
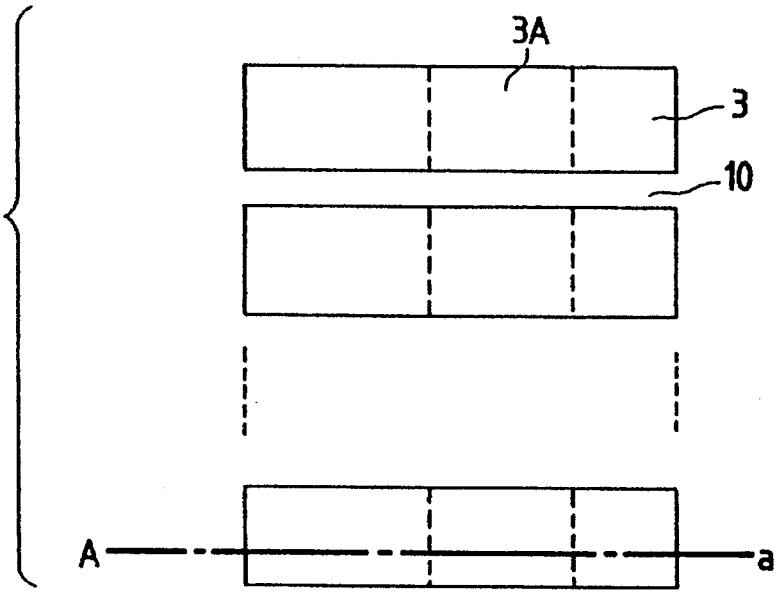
FIG. 7(*a*) is a plan view and FIG. 7(*b*) is a vertical cross sectional view illustrating a state of forming heat generating elements in the manufacturing process shown in FIG. 5.
Figure 7B:
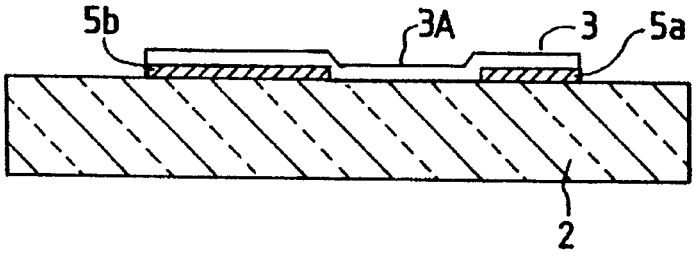
Figure 8A:
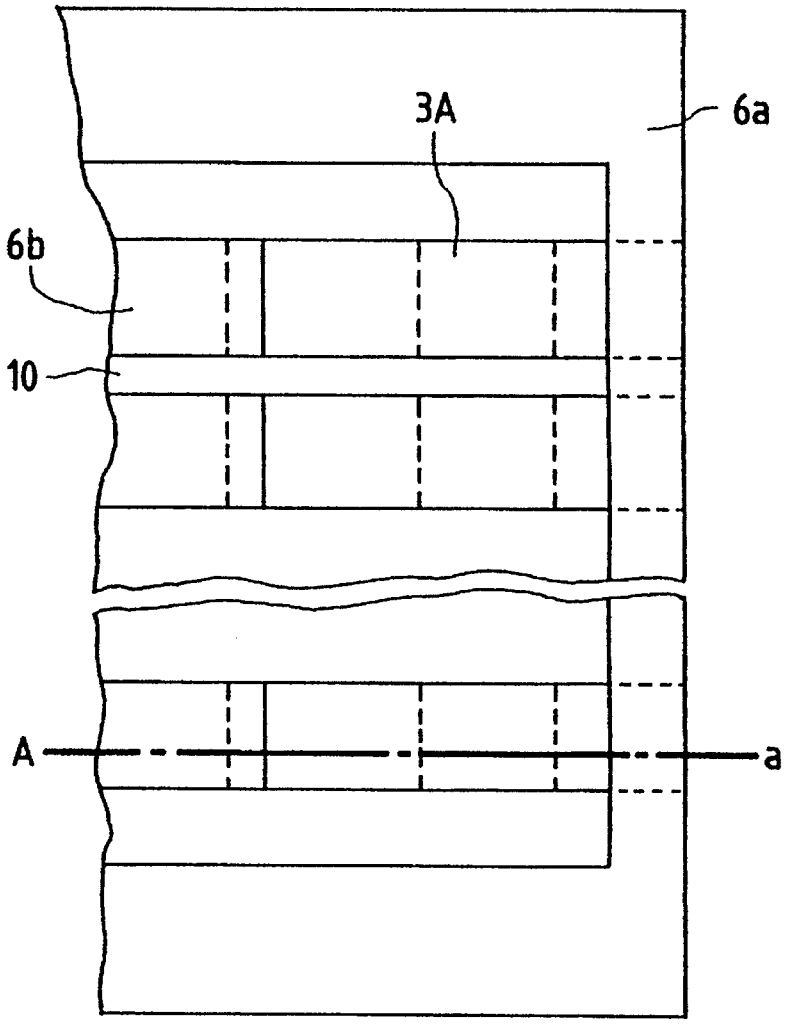
FIG. 8(*a*) is a plan view and FIG. 8(*b*) is a vertical cross sectional view illustrating a state of forming upper electrodes in the manufacturing process shown in FIG. 5.
Figure 8B:
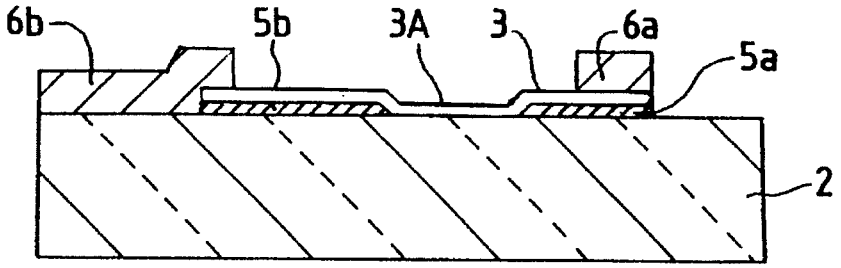
Figure 9A:
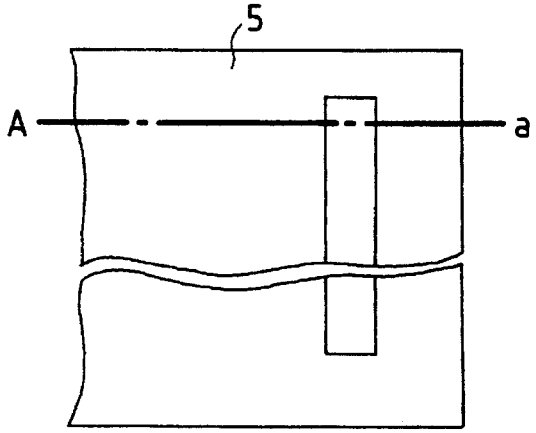
FIG. 9(*a*) to (*e*) is an explanatory view of a third embodiment for a method of manufacturing a thermal head according to the present invention.
Figure 9B:
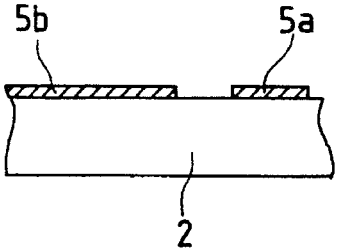
Figure 9C:
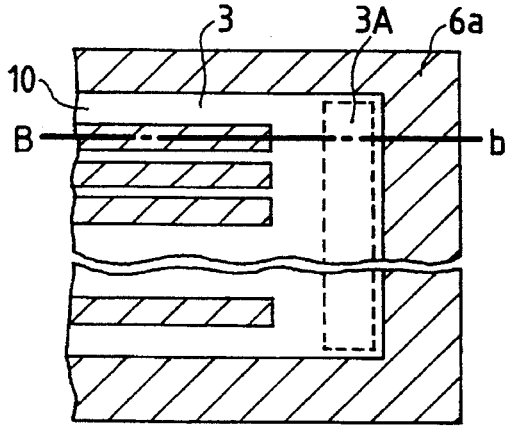
Figure 9D:
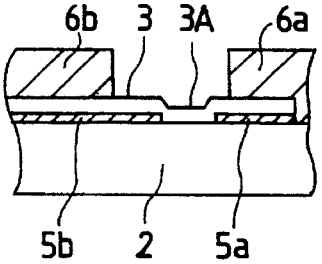
Figure 9E:
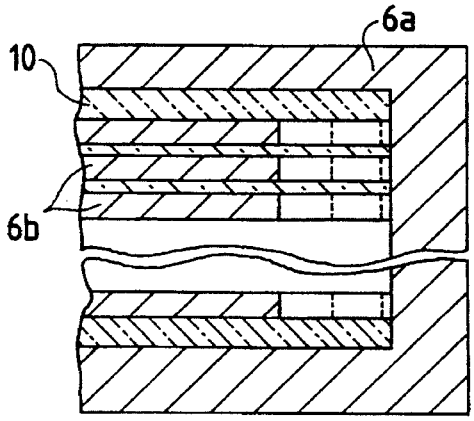

FIG. 6 to FIG. 8 illustrates a method of manufacturing the thermal head in this embodiment. Since the manufacturing steps in this embodiment are similar to the manufacturing steps in the previous embodiment, only the difference between them will be explained while omitting duplicate explanations. Also in these figures, it is assumed for the sake of the explanation that the shape of the glaze layer 2 is not a convex shape forming the small protrusion 2B but planer shape. In each of the figures, (a) is a plan view and (b) is a vertical cross sectional view.

In this embodiment, as shown in FIG. 6 to FIG. 8, both of the lower electrode 5 and the upper electrodes 6a and 6b are formed shorter on the side of the common electrode than on the side of the individual electrode, and the common electrode 6a is formed by photolithography so as to be extended along the slope of the convex portion of the small protrusion 2B.

Then, with such a constitution, the lower electrodes 5a and 5b is formed as far as the top of the small protrusion 2B, and the heat generating portion 3A is formed at the position on the top. The upper individual electrode 6b is formed at low position spaced apart from the top where the heat generating portion 3A is situated. On the other hand, since the upper common electrode 6a is formed near the heat generating portion 3A, the distance from the heat generating portion 3A to the edge of the head on the side of the common electrode can be reduced. Accordingly, printing quality can be improved upon printing on rough paper or the like requiring hot peeling.

A third embodiment of a method of manufacturing a thermal head according to the present invention will be shown in FIG. 9(*a*)–(*e*) as a third embodiment. FIG. 9(*a*)–(*e*) illustrate schematic views for the manufacturing steps. Also in this embodiment, it is assumed for the convenience of explanation that the shape of the glaze layer 2 is not convex forming the small protrusion 2B but planer. In each of the figures, (a), (c), (e) are plan views, while (b) and (d) are vertical cross sectional views.

At first in FIG. 9(*a*) and (*b*), a film of Mo, Ti, W, Nb, Ta or Zr as the lower electrode 5 is formed on the glaze layer 2 by means of vapor deposition, sputtering or the like and then the inter-electrode distance of the heat generating region of the heat generating element 3, that is, a pattern for defining the dot size of the heat generating portion 3A is formed by photolithography. In this instance, dry etching using the $CF_4$ series gas is adopted for etching to remove the region as the heat generating portion 3A at a high accuracy.

Then, in FIG. 9(*c*) and (*d*), a film of a heat generating element 3 such as of Ta—$SiO_2$ or Nb—$SiO_2$ is formed so as to cover the lower electrode 5 (made up of lower common electrode 5a and lower individual electrode 5b) by means of vapor deposition, sputtering or the like and, successively, a film of the upper electrodes 6a and 6b made of Al or the like is formed above the heat generating element 3 by means of vapor deposition, sputtering or the like. Then, an upper electrode wiring pattern is at first formed to a position at which only the upper electrodes 6a and 6b is separated outwardly from the boundary between the lower electrode and the heat generating element 3 by photolithography. In this instance, as described previously, since the boundary between the upper electrode 6 and the heat generating element 3 is space apart from the heat generating portion 3A, no undesired effect is given on heat generation or the like even if the pattern is formed with slight displacement.

Then, in FIG. 9(*e*), a comb-like slit 10 is formed by photolithography for defining the size of the heat generating portion 3A in the direction of arrangement and partitioning the individual electrode wirings from each other. In this case, since both Mo, Ti, W, Nb, Ta or Zr as the material for the lower electrode 5 and Ta—$SiO_2$ or Nb—$SiO_2$ as the material for the heat generating element 3 can be dry etched by a $CF_4$ series gas, dry etching can be applied continuously by using an identical resist pattern.

As described above by the manufacturing method in this embodiment, since the lower electrode 5 and the heat generating element 3 can be etched continuously by the identical gas in the same manner as the manufacturing method described previously, reduction of the production cost can be expected, there is no worry of injuring the heat generating element 3 and the heat generating portion 3A with less variation of resistance value can be formed at a high accuracy.

Further, since the electrode near the heat generating portion 3A is formed with a thin, highly heat resistant hard metal, a thermal head of high durability can be obtained.

Accordingly, printing of letters and pictures at high quality can be conducted by the thermal head according to this embodiment.

Further, since the production process comprises forming a film of the heat generating element 3 above the lower electrode 5 by means of sputtering or the like, successively forming the film of the upper electrodes 6*a* and 6*b*, subsequently forming the upper electrode wiring pattern by etching only for the upper electrodes 6*a* and 6*b* and forming patterns for the heat generating elements 3 and the lower electrode 5 by continuous etching, a film forming process such as sputtering and etching process can be conducted successively to facilitate the process control.

Another embodiment of the thermal head according to the present invention and manufacturing method therefor will be explained as a fourth embodiment. In this embodiment, explanation will be made only for the portions different from the first embodiment and duplicate explanation for other similar portions to those in the previous embodiments will be omitted.

In the thermal head according to this embodiment, the lateral size of the pattern for the lower individual electrodes 5*b* in the direction of arranging the heat generating portions in the first embodiment is made smaller than the lateral size of the pattern for the heat generating elements 3 in the direction of arranging the heat generating portions and the lower individual electrode 5*b* are completely covered, so that the lower individual electrode 5*b* is not exposed out of the heat generating element 3.

The method of manufacturing this embodiment will be explained.

Figure 10:
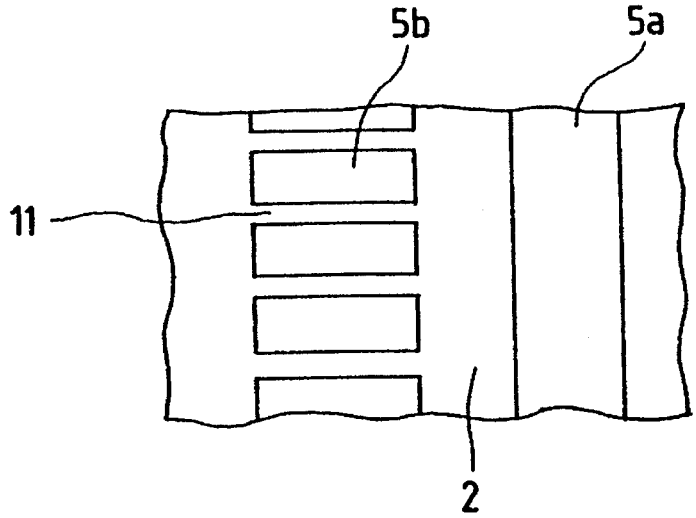
FIG. 10 is a plan view illustrating a state of forming lower electrodes in a fourth embodiment of a thermal head according to the present invention.
Figure 11A:
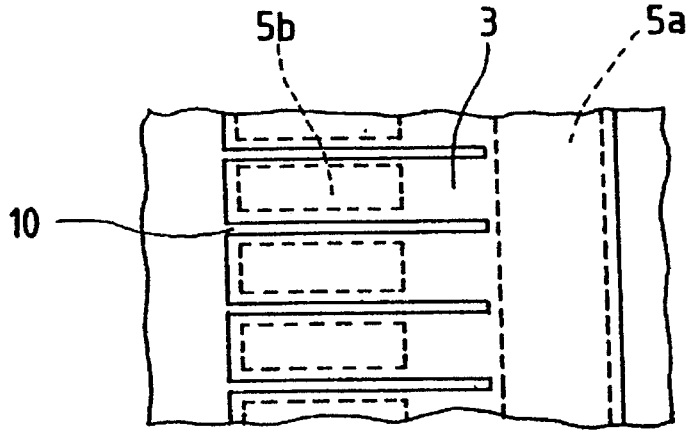
FIG. 11(*a*) is a plan view and FIG. 11(*b*) is a cross sectional view for a main portion illustrating a state of forming heat generating elements in the fourth element of a thermal head according to the present invention.
Figure 11B:
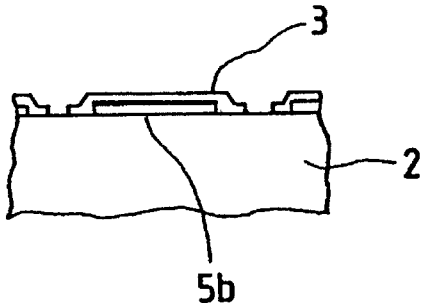
Figure 13:
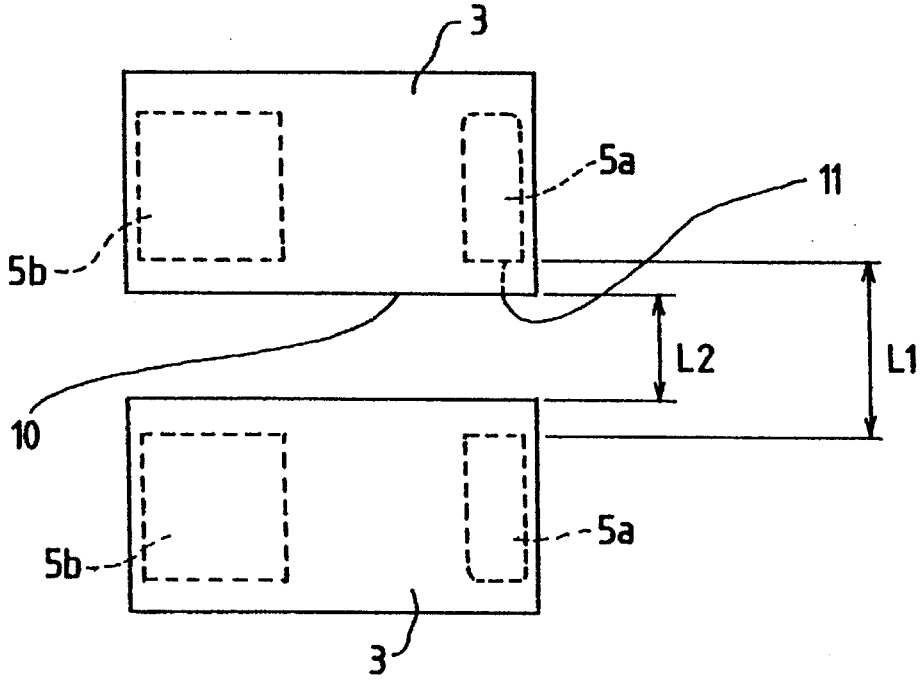
FIG. 13 is a conceptional view illustrating a relationship between a lower individual electrode and a heat generating element in a thermal head of the fourth embodiment.

FIG. 10 and FIGS. 11(*a*) and 11(*b*) are schematic views for the manufacturing steps of the heat generating elements and it is assumed here for the convenience of explanation that the glaze layer 2 has not a convex shape forming the small protrusion 2B but a planer shape. FIG. 11(*b*) is a cross sectional view for a principal portion and FIG. 13 is a conceptional view illustrating a relationship between the lower individual electrode 5*b* and the heat generating element 3 in the thermal head of this embodiment.

At first, as shown in FIG. 10, a lower electrode is formed on a glaze layer 2. The lower electrode comprises lower individual electrodes 5*b* and a lower common electrode 5*a* in the same manner as in the first embodiment which is made of Mo and has a thickness of about 0.1 um. Further, in this embodiment, as shown in FIG. 13, the lower individual electrode 5*b* has a lateral size smaller than that of the heat generating element 3 and is patterned substantially in a square shape, the size of the heat generating portion 3*a* in the direction of arrangement is defined and a slit 11 is formed between the adjacent lower individual electrodes 5*b* to completely partition them (the lateral size is indicated as L1 in the figure).

Then as shown in FIGS. 11(*a*) and 11(*b*), a film of the heat generating element 3 such as made of Ti—$SiO_2$ is formed so as to cover the lower electrodes 5*a* and 5*b* by means of vapor deposition, sputtering or the like. Then, a comb-like slit 10 (the lateral size is indicated on L2 in the figure) is formed for defining the size of the heat generating element 3A in the direction of arrangement. In this case as shown in FIGS. 11(*a*) and 11(*b*) and FIG. 13, the lateral size L1 for the slit 11 is made greater than the lateral size L2 for the slit 10, and the heat generating element 3 is formed such that the lower individual electrode 5*b* of the lower electrode is completely covered with the heat generating element 3. Namely, the lower individual electrodes 5*b* is within the pattern of the heat generating element 3. In the direction of arranging the lower electrode, the size from the side of the lower individual electrode 5*b* to the corresponding side of the heat generating element 3 covering the lower individual electrode is defined less than 5 um.

Figure 12:
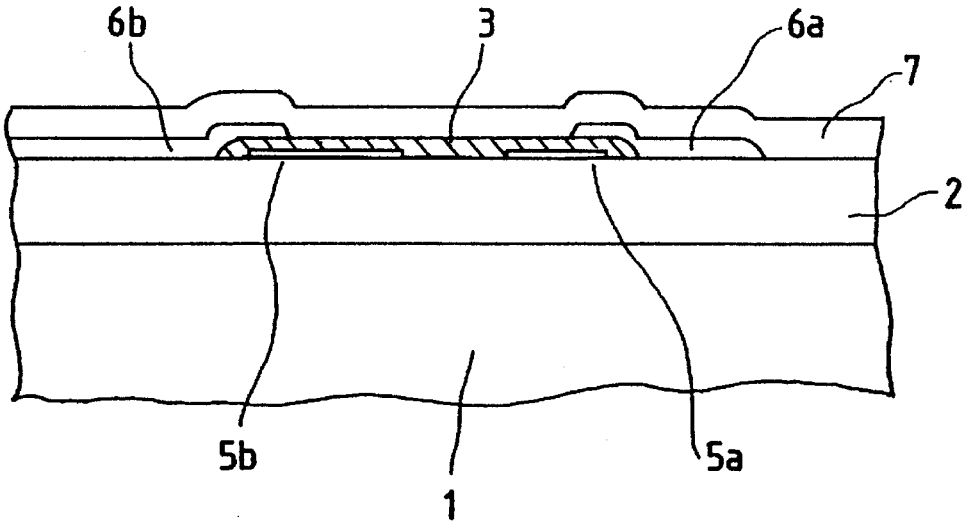
FIG. 12 is a vertical cross sectional view of the fourth embodiment of a thermal head according to the present invention.

Then, as shown in the conceptional view of FIG. 12, a film of an upper electrodes 6*a* and 6*b* made of Al or the like is formed in the same manner as in the first embodiment and then a protection layer 7 is deposited over the entire surface.

The material for the lower electrodes 5*a* and 5*b* is not restricted only to Mo but the electrode may also be made of a metal material such as Ti, W, Nb, Ta, Zr, or with an alloy comprising the same as the main ingredient in the same manner as in the first embodiment. Also for the material of the heat generating element 3, a mixture such as Ta—$SiO_2$ or Nb—$SiO_2$ can be used in the same manner. Accordingly, while the lower electrode and the heat generating element 3 can be dry etched by the $CF_4$ type gas, etching for the lower electrodes 5*a* and 5*b* and the etching for the heat generating element 3 are applied in the quite different operation steps and the lower individual electrode 5*b* is covered with the heat generating element 3 and situates within the pattern during etching of the heat generating element 3, so that an optimal etching gas can be selected upon etching the heat generating element 3 while only considering the material constituting the heat generating element 3. As described above, in this embodiment, since the etching is conducted in separate steps, there is no problem in the difference of etching rates between the heat generating element 3 and the lower individual electrode 5*b*. Further, the problem of deviation for the patterns between the lower electrode and the heat generating element 3 which was liable to occur upon conducting etching in separate steps can be overcome by making the lower individual electrode 5*b* in such a size as covered by the heat generating element 3.

As described above in this embodiment, since the film of the lower electrodes 5*a* and 5*b* is formed and dry etched preceding to the heat generating element 3, it is completely covered with the heat generating element 3 upon etching of the heat generating element 3, and there is no worry of damaging the lower electrodes 5*a* and 5*b* and the accuracy for forming the dot of the heat generating portion 3*a* can be enhanced to stabilize the resistance value.

In addition, since the lower electrodes 5*a* and 5*b* in this embodiment are as seen as about 0.1 um, the side edge is reduced and, accordingly, a desired resistance can be obtained stably and, since it is made of the highly heat resistant hard metal, a thermal head of high durability can be obtained.

Then, explanation will be made to other embodiment of a thermal head according to the present invention and a fifth embodiment of the manufacturing method.

This embodiment is a further modified embodiment of the thermal head shown in the fourth embodiment. Accordingly, explanation for this embodiment will be made only to the portions different from the fourth embodiment and duplicate explanations for other portions similar with those in the previous embodiment will be omitted.

In the thermal head of this embodiment, the lateral size of the pattern for the lower individual electrode 5b in the direction of arranging the heat generating portions 3A is made greater than the lateral size of the pattern for the heat generating element 3 in the direction of arranging the heat generating portions 3A, so that the slit 11 between the adjacent lower individual electrodes 5b and 5b is made narrower than the pitch between the heat generating elements 3.

The manufacturing method in this embodiment will be explained.

Figure 14:
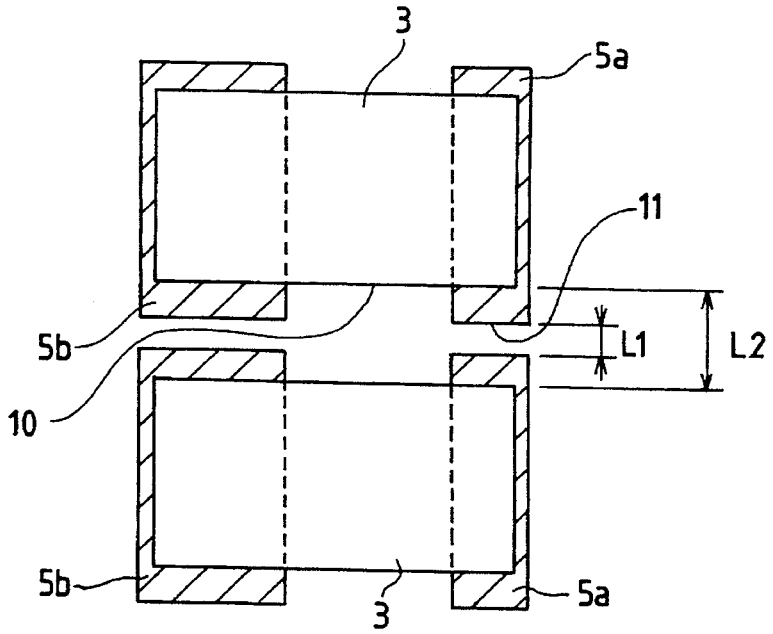
FIG. 14 is a conceptional view illustrating a relationship between a lower individual electrode and a heat generating element in a thermal head of a fifth embodiment.

FIG. 14 is a conceptional view illustrating a relationship between a lower individual electrode 5b and a heat generating element 3 in a thermal head of this embodiment. For the convenience of explanation, it is assumed that the glaze layer 2 is not in a convex shape forming the small protrusion 2B but in a planer shape.

At first, the lower electrode is formed on a glaze layer 2. The lower electrode comprises lower individual electrodes 5b and a lower common electrode 5a in the same manner as in the previous embodiment. In this embodiment, a pattern is formed such that the lateral size of the lower individual electrode 5b in the direction of arranging the heat generating portions 3A is made greater than the lateral size of the heat generating element 3 in the direction of arranging the heat generating portions 3A to define the size in the direction of arranging the heat generating portions 3A, and a slit 11 is formed between the adjacent lower individual electrodes 5b and 5b to completely partition them.

Then, a film of the heat generating elements 3 is formed on the lower electrodes 5a and 5b by means of vapor deposition, sputtering or the like and a comb-like slit 10 is formed for defining the size of the heat generating portion 3A in the direction of arrangement. In this embodiment, the lateral size L2 for the slit 10 is made greater than the lateral size L1 for the slit 11. In this case, etching for the portion of the film of the heat generating element 3 formed on the lower individual electrode 5b is applied only to the heat generating element 3, and the lateral size of the lower individual electrode 5b in the direction of arranging the heat generating portions 3A is made greater than the lateral size of the heat generating element 3, so that an excess portion of the lower individual electrode 5b extends beyond the lateral size of the heat generating element 3 (shown by the hatched portion in FIG. 14) in the direction of arranging the heat generating portions 3A. However, even when the excess portion is left on the glaze layer 2, since the adjacent lower individual electrodes 5b are partitioned from each other by the slit formed upon etching, no short circuit is caused upon current supply.

Then, after forming a film of an upper electrode made of Al or the like, a protection layer is deposited over the entire surface.

The lower electrodes 5a and 5b may be made of a metal material such as Mo, Ti, W, Nb, Ta and Zr or an alloy comprising the same as the main ingredient which is the material for the lower electrodes 5a and 5b described previously. As the material for the heat generating element 3, Ti—$SiO_2$, Nb—$SiO_2$ or the like can be used. Accordingly, the lower electrodes 5a and 5b and the heat generating 3 can be dry etched by a $CF_4$ type gas. However, in the working operation steps in this embodiment, since the etching for the lower electrodes 5a and 5b and the etching for the heat generating element 3 are applied individually and respectively in separate steps, an optimal etching gas can be selected upon applying etching the heat generating element 3 while considering only the etching rate of the material constituting the heat generating element 3.

Further, both of the lower electrodes 5a and 5b and heat generating element 3 can be dry etched by the $CF_4$ type gas in this embodiment and this means that the lower individual electrode 5b and the heat generating element 3 can be etched continuously by an identical gas upon forming the slit 10 that defines the size of the heat generating element 3 in the direction of arranging the heat generating portions 3A and, accordingly, the excess portion of the lower individual electrode 5b can be removed also upon etching the heat generating element 3.

As described above in this embodiment, since etching for the lower electrodes 5a and 5b is conducted preceding to the formation of the heat generating element 3 and the slit 11 is formed between each of the lower individual electrodes 5b in the direction of arranging the heat generating portions 3A for completely partitioning them, when the lower individual electrode 5b and the heat generating element 3 are etched continuously and if etching for the lower electrodes 5a and 5b is insufficient due to the difference in the etching rate between the lower individual electrode 5b and the heat generating element 3, short circuit caused between the adjacent individual electrodes 5b upon current supply can be prevented completely, thereby enabling to conduct printing for letters or pictures at high quality.

Figure 15:
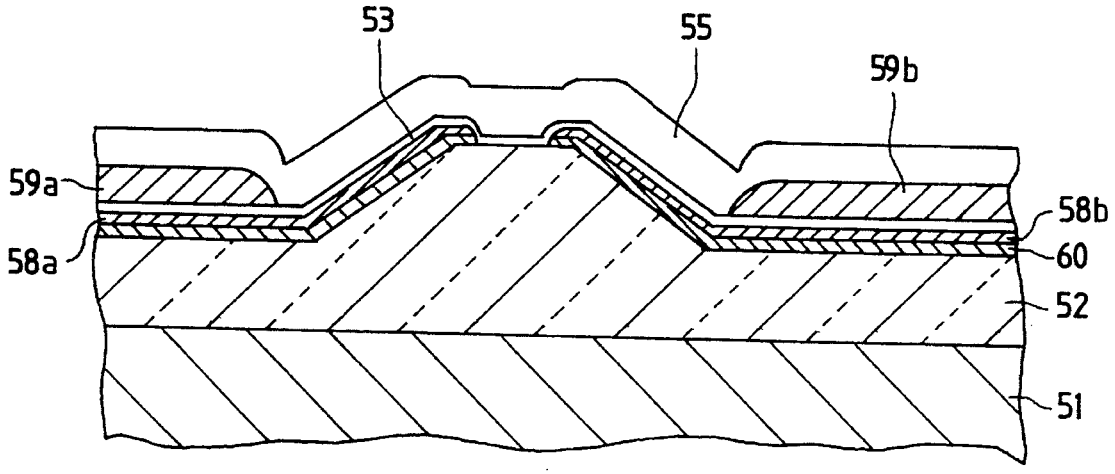
FIG. 15 is a vertical cross sectional view illustrating a sixth embodiment of a thermal head according to the present invention.
Figure 16:
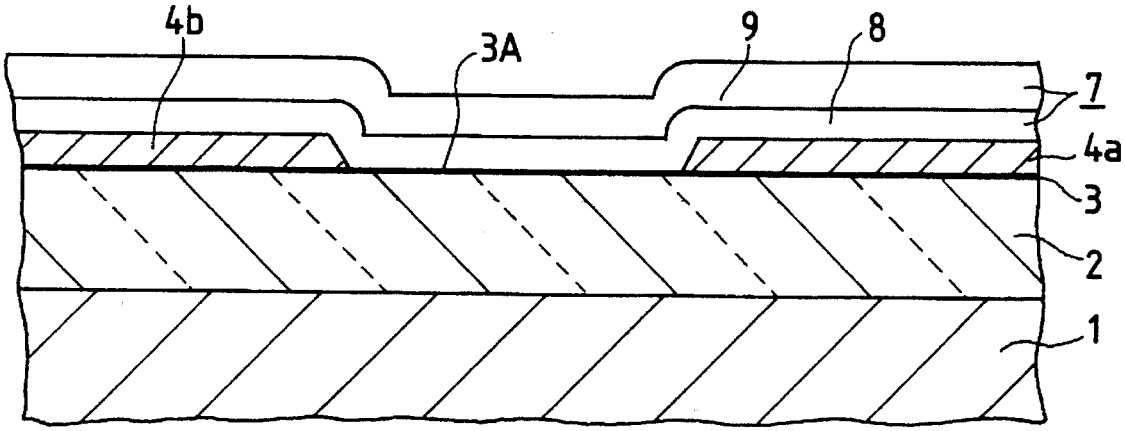
FIG. 16 PRIOR ART
FIG. 16 is a vertical cross sectional view illustrating a thermal head of the prior art.
Figure 17:
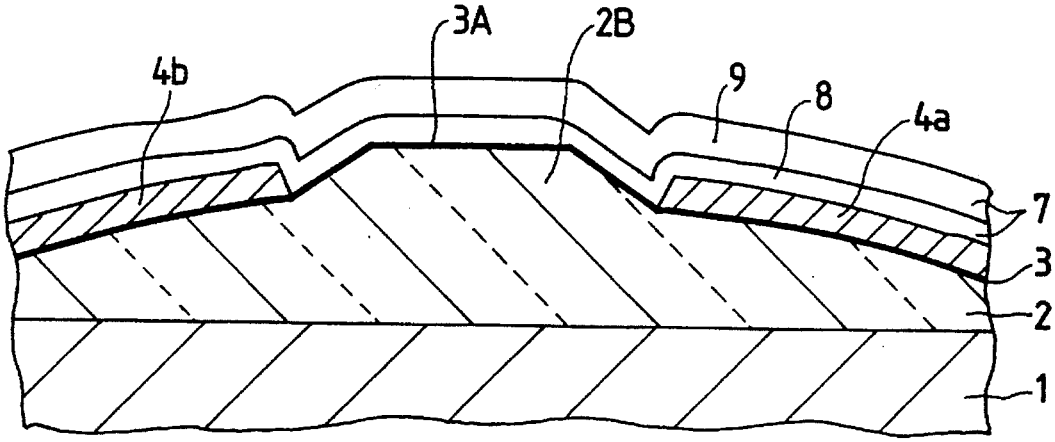
FIG. 17 PRIOR ART
FIG. 17 is a vertical cross sectional view illustrating a thermal head of the prior art.
Figure 18:
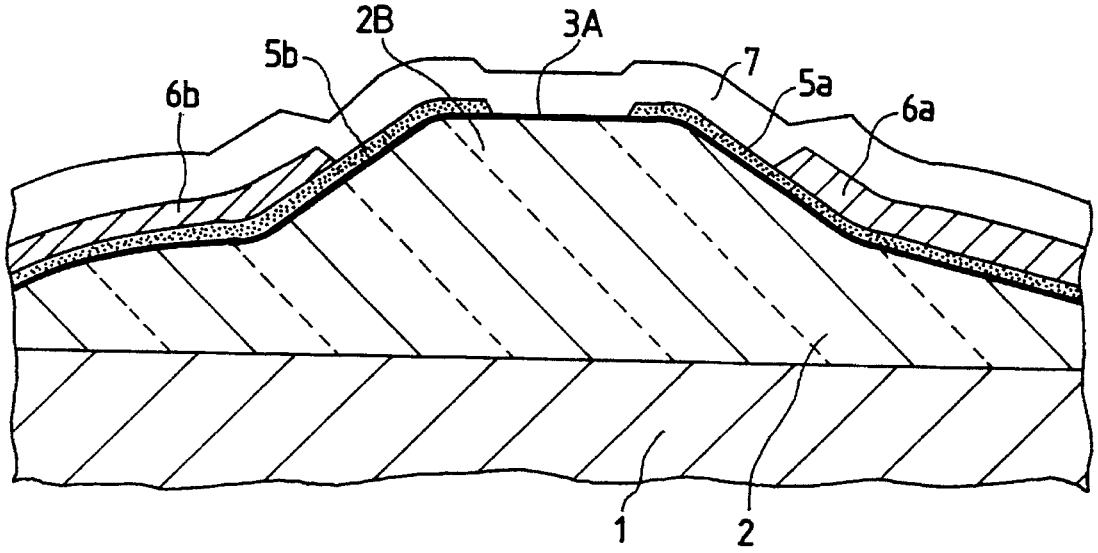
FIG. 18 PRIOR ART
FIG. 18 is a vertical cross sectional view illustrating a thermal head of the prior art.
Figure 19:
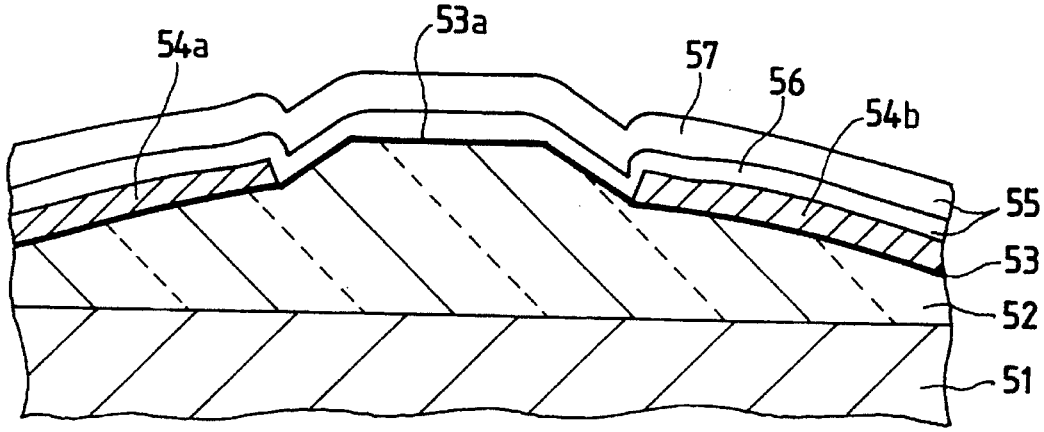
FIG. 19 PRIOR ART
FIG. 19 is a vertical cross sectional view illustrating a thermal head of the prior art.

In a thermal head of an embodiment shown in FIG. 15, a glaze layer 52 made of a less heat conductive material such as heat resistant glass and functioning as a temperature keeping layer is laminated, with a portion being protruded upwardly, on the upper surface of a substrate 51 made of an insulative material such as alumina and a lower electrode comprising a lower individual electrode 58a and a lower common electrode 58b made of Mo and formed at a position corresponding to a position for forming each of heat generating resistor bodies 53 is formed to the upper surface of the protruding portion of the glaze layer 52.

Further, in this embodiment, a bonding layer 60 made of a material such as Ta—$SiO_2$ or $SiO_2$ is formed between the glaze layer 52 and the lower electrode 58a and 58b, and the bonding layer 60 is formed to a thickness of about 3–20 nm. The bonding layer 60 remarkably enhances the adhesion between the lower electrodes 58a and 58b and the glaze layer 52.

Further, a plurality of heat generating resistor bodies 53 made of a material such as Ta—$SiO_2$ are arranged linearly on the upper surface of the lower electrode, and an upper electrode made of a material such as Al and comprising upper individual electrodes 59a connected individually to the heat generating resistor body 53 respectively and an upper common electrode 59b connected to all the heat generating resistance bodies 53 are formed at the positions spaced apart from the boundary between the lower electrodes 58a and 58b and the heat generating resistor body 53 at the upper surface of the heat generating resistor body 53. Further, a protection layer 55 is laminated on the upper surface of the substrate 51, the glaze layer 52, each of the heat generating resistor bodies 53 and each of the electrodes 58a, 58b, 59a and 59b for protecting each of the heat generating resistor bodies 53 and the each of the electrodes 58a, 58b, 59a and 59b.

The upper electrodes 59a and 59b may be saved as required.

The operation of this embodiment will be explained next.

The thermal head of the above-mentioned constitution is manufactured in this embodiment by at first forming a film of a material such as Ta—$SiO_2$ or $SiO_2$ as the bonding layer 60 to the upper surface of the glaze layer 52 by means of vapor deposition, sputtering or the like, forming the film of a Mo material as the lower electrodes 58*a* and 58*b* to the upper surface of the bonding layer 60 by means of vapor deposition, sputtering or the like, and then etching the bonding layer 60 and the lower electrodes 58*a* and 58*b* such that they forms a pattern defining the inter-electrode distance of the heat generating region of the heat generating resistor bodies 53.

Then, after forming a film of the heat generating resistor body 53 such as Ta—$SiO_2$ so as to cover the lower electrodes 58*a* and 58*b* by means of vapor deposition, sputtering or the like, etching is applied by photolithography so as to form a pattern of arranging the heat generating portions. In this case, if the heat generating resistor body 53 is formed with Ta—$SiO_2$ which is the same material as the material for forming the bonding layer 60, it is no more necessary to change, for example, a target for sputtering and the film of the heat generating resistor body 53 can be formed efficiently.

Then, after forming a film of the upper electrodes 59*a* and 59*b* made of Al or the like on the heat generating resistor body 53, it is etched into a predetermined pattern by photolithography, and the upper electrodes 59*a* and 59*b* is formed at a position spaced outwardly from the boundary between the lower electrodes 58*a* and 58*b* and the heat generating resistor body 53. Subsequently, the protection layer 55 is laminated on the upper surface of the substrate 51, the glaze layer 52, each of the heat resistant bodies 53 and each of the electrodes 58*a*, 58*b*, 59*a* and 59*b*.

In this embodiment, since the lower electrodes 58*a* and 58*b* are formed by way of the bonding layer 60 to the glaze layer 52 and the stresses in the films are similar between the material for forming the bonding layer 60 and the material for forming the heat generating resistor body 53, the stresses can be balanced between the bonding layer 60 and the heat generating resistor body 53 to remarkably enhance the adhesion of the lower electrodes 58*a* and 58*b* to the glaze layer 52.

Accordingly, in this embodiment, since the stresses can be balanced between the bonding layer 60 and the heat generating resistor body 53 by forming the lower electrodes 58*a* and 58*b* by way of the bonding layer 60 to the glaze layer 52, adhesion of the lower electrodes 58*a* and 58*b* to the glaze layer 52 can be improved remarkably to surely prevent peeling of the lower electrodes 58*a* and 58*b* and remarkably improve the head quality.

Further, the present invention is not restricted only to the embodiments described previously but various modifications are possible as required. For instance, it is of course possible to apply the method of manufacturing the lower individual electrode and the heat generating element of the thermal head shown in the fourth embodiment and the fifth embodiment to the thermal head of the second embodiment. Further, in the embodiments described previously, combination of the materials constituting the lower electrode and the material constituting the upper electrode is optional and the object of the present invention can be attained in any of the combinations, but a thermal head comprising a combination of the lower electrode made of Mo and the upper electrode made of Al is most preferred in view of the adhesion upon vapor deposition, stability upon heating or the like.

As has been described above, in the thermal head according to the present invention, since the heat generating element is formed above the lower electrode, the upper individual electrode can be spaced apart sufficiently, and a heat generating element at high accuracy can be formed with a real edge in which the distance from the heat generating portion to the edge of the head on the side of the common electrode is reduced and printing quality can be improved upon printing, for example, for rough paper requiring hot peeling.

Further, in the method of manufacturing the thermal head according to the present invention, since the lower electrode and the heat generating element can be etched continuously by the identical gas, reduction of the production cost can be expected, there is no worry of injuring the heat generating element and a heat generating portion at high accuracy with less variation of the resistance value can be formed.

Further, since the electrode near the heat generating portion is formed with a thin, highly heat resistant hard metal, a thermal head of excellent durability can be obtained.

Accordingly, a thermal head capable of conducting printing for letters and pictures at high quality even to rough paper or the like can be obtained.

Further, since stresses can be balanced between the bonding layer and the heat generating resistor body by forming the lower electrode by way of the bonding layer to the glaze layer in the thermal head according to the present invention, advantageous effects can be provided for example that adhesion of the lower electrode to the glaze layer can be improved remarkably, peeling of the lower electrode can be prevented surely and the head quality can be improved remarkably.

What is claimed is:

1. A thermal head comprising:

a temperature keeping layer disposed on a substrate, a plurality of heat generating elements, each of said heat generating element including a heat generating portion formed on the temperature keeping layer, a plurality of individual electrodes, each of said individual electrodes connected to a corresponding heat generating element, and a common electrode connected to said heat generating elements, respectively, such that the heat generating portion of each of said heat generating elements is formed between one of the individual electrodes and the common electrode, wherein each of the individual electrodes and the common electrode have a dual layered structure including a lower electrode and an upper electrode, the lower electrode is formed between the temperature keeping layer and the heat generating elements, and the upper electrode is formed above said heat generating elements.

2. A thermal head according to claim 1, wherein the lower electrode of each of the individual electrodes includes a lower common electrode and a lower individual electrode, the lower common electrode being spaced from the lower individual electrode by a first distance, wherein the upper electrode of each of the individual electrodes includes an upper common electrode and an upper individual electrode which are spaced apart by a second distance, and wherein the first distance is less than the second distance.

3. A thermal head as defined in claim 2, wherein the upper common electrode is located closer to the heat generating portion than the upper individual electrode.

4. A thermal head as defined in claim 3, wherein a lateral size of the lower individual electrode is smaller than a lateral size of the heat generating element.

5. A thermal head as defined in claim 3, wherein a lateral size of the lower individual electrode is greater than a lateral size of the heat generating element.

6. A thermal head as defined in claim 3, wherein the heat generating element comprises at least one element from the group consisting of Ta and Nb, and an Si—O series insulator, and wherein the lower electrode comprises at least one element from the group consisting of Mo, Nb, W, Ti, Ta and Zr.

7. A thermal head as defined in claim 2, wherein a lateral size of the lower individual electrode is smaller than a lateral size of the heat generating element.

8. A thermal head as defined in claim 2, wherein a lateral size of the lower individual electrode is greater than a lateral size of the heat generating element.

9. A thermal head as defined in claim 2, wherein the heat generating element comprises at least one element from the group consisting of Ta and Nb, and an Si—O series insulator, and wherein the lower electrode comprises at least one element from the group consisting of Mo, Nb, W, Ti, Ta and Zr.

10. A thermal head as defined in claim 2, wherein a thickness of the lower electrode is between 20 nm and 300 nm.

11. A thermal head as defined in claim 1, wherein each of the heat generating elements comprises at least one element from the group consisting of Ta and Nb, and an Si—O series insulator, and wherein the lower electrode comprises at least one element from the group consisting of Mo, Nb, W, Ti, Ta and Zr.

12. A thermal head as defined in claim 1, wherein a thickness of the lower electrode is between 20 nm and 300 nm.

13. A thermal head as defined in claim 1, wherein a thickness of the lower electrode is between 20 and 300 nm and a thickness of each of the heat generating elements is greater than the thickness of said lower electrode.

14. A thermal head comprising:

a glaze layer formed on an electrically insulative substrate;

a lower electrode layer formed over the glaze layer, the lower electrode layer including a plurality of lower individual electrodes and a lower common electrode, wherein an exposed portion of the glaze layer is provided between each of the lower individual electrodes and the lower common electrode;

a plurality of heat generating resistor bodies formed on the lower electrode layer such that each of said heat generating resistor body includes a heat generating portion formed on the exposed portion of the glaze layer extending between one of the lower individual electrodes and the lower common electrode; and an upper electrode layer formed on the plurality of heat generating resistor bodies, the upper electrode layer including a plurality of upper individual electrodes, each of said upper individual electrodes being located over one of the lower individual electrodes, the upper electrode layer also including an upper common electrode located over the lower common electrode.

15. The thermal head according to claim 14, wherein the lower electrode layer comprises Mo, and a bonding layer is formed between said lower electrode and said glaze layer.

16. A thermal head as defined in claim 15, wherein a thickness of the bonding layer is 2 to 20 nm.

17. A thermal head as defined in claim 15, wherein the bonding layer and the plurality of heat generating resistor bodies are formed from a common material.

* * * * *